US006780030B2

(12) United States Patent
Yoshinaga et al.

(10) Patent No.: US 6,780,030 B2
(45) Date of Patent: Aug. 24, 2004

(54) INFORMATION PROCESSING EQUIPMENT

(75) Inventors: Hisashi Yoshinaga, Kawasaki (JP); Yoshiaki Hiratsuka, Kawasaki (JP); Masanori Yamaguchi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 3 days.

(21) Appl. No.: 10/365,487

(22) Filed: Feb. 13, 2003

(65) Prior Publication Data

US 2004/0018758 A1 Jan. 29, 2004

(30) Foreign Application Priority Data

Jul. 23, 2002 (JP) ..... 2002-214069

(51) Int. Cl.[7] ..... H01R 4/66

(52) U.S. Cl. ..... 439/92; 361/818; 174/35 R; 174/35 GC; 174/51

(58) Field of Search ..... 439/92; 361/818; 174/35 R, 35 GC, 51

(56) References Cited

U.S. PATENT DOCUMENTS 5,218,760 A * 6/1993 Colton et al. ..... 439/92
5,398,156 A * 3/1995 Steffes et al. ..... 439/92
5,934,915 A * 8/1999 Henningsson et al. ..... 439/92
5,951,307 A * 9/1999 Klein et al. ..... 439/92
6,019,614 A * 2/2000 Baur et al. ..... 439/92
6,118,071 A * 9/2000 Munch et al. ..... 174/51
6,149,443 A * 11/2000 Moran ..... 439/92
6,344,972 B2 * 2/2002 Esticule et al. ..... 439/92
6,456,504 B1 * 9/2002 LoForte et al. ..... 439/92
6,500,012 B1 * 12/2002 Billenstein et al. ..... 361/818
6,540,530 B2 * 4/2003 Bass et al. ..... 439/92

FOREIGN PATENT DOCUMENTS

| | | |
|---|---|---|
| JP | 8-162853 | 6/1996 |
| JP | 8-228088 | 9/1996 |
| JP | 9-064581 | 3/1997 |
| JP | 10-255912 | 9/1998 |
| JP | 11-220263 | 8/1999 |

* cited by examiner

*Primary Examiner*—Gary Paumen
(74) *Attorney, Agent, or Firm*—Staas & Halsey LLP

(57) ABSTRACT

An SG pattern is provided at the circumference of the outermost layer of a printed circuit board and the SG pattern is connected to a frame ground of a case by grounding plates so that the space between connection points is smaller than a distance determined by a signal wavelength. The grounding plates are disposed at three sides other than the side at which a connector mounting plate is disposed to hold the printed circuit board therebetween by leaf spring-like contacts. The mounting plate is connected to the SG pattern to be electrically connected to the grounding plate.

13 Claims, 9 Drawing Sheets

INFORMATION PROCESSING EQUIPMENT

BACKGROUND OF THE INVENTION

1. Field of the Invention

The present invention relates to information processing equipment for inhibiting electromagnetic interference (hereinafter referred to as "EMI") and, in particular, it relates to information processing equipment, such as a personal computer, for inhibiting electromagnetic noise from printed circuit boards.

2. Description of the Related Art

Conventionally, in information processing equipment such as desktop or notebook personal computers, it is required to inhibit electromagnetic noise. However, in such information processing equipment, as the operating frequency increases, it becomes more and more difficult to prevent the electromagnetic noise or EMI from leaving printed circuit boards.

On the other hand, for the purpose of preventing the EMI, along with legal regulations in each country, international standards such as CISPR (Comite International Special des Pertubations Radioelectrique, or The International Special Committee on Radio Interference in the IEC (International Electrotechnical Commission)) are established and, in Japan, a domestic standard is specified by VCCI (Voluntary Control Council for Interference by Information Technology Equipment). In order to satisfy such standards, it is important to reduce undesired electromagnetic radiation.

Conventionally, a printed circuit board used for a main board of a personal computer is mounted on a plurality of bosses provided on the bottom surface of a case, and is fastened by screws onto the bosses, wherein a signal ground pattern (hereinafter referred to as the "SG pattern") of the printed circuit board is connected to a frame ground on the bottom surface of the case via the bosses so that impedance is lowered to prevent the EMI.

In order to reduce the electromagnetic radiation due to resonance by connecting the SG pattern of the printed circuit board to the frame ground as described above, it is necessary to establish an appropriate distance between connection points according to the operating frequency in use. At present, as the operating frequency increases as CPUs become faster, for the prevention of EMI, it is necessary to connect the SG pattern of the printed circuit board to the frame ground of the case at multiple points and at minimum spacing (1/10 or less of a clock frequency wavelength $\lambda$). As an example, as the wavelength is 30 cm at a clock frequency of 1 GHz, the spacing between the connection points must be as small as 3 cm or less.

However, when the spacing is reduced by increasing the number of the conventional bosses for mounting the printed circuit board, there is a problem in that productivity is reduced as the area cost is increased and the mounting efficiency is reduced because more screws must be used.

In order to solve such problem, the following technique is known.

Unexamined Patent Publication (Kokai) No. 10-255912 (published on Sep. 25, 1998) discloses a technique for preventing undesired electromagnetic radiation by forming a ground pattern inside a printed circuit board and bringing a contact plate spring member in a connector housing into contact with said ground pattern. Thus, it discloses that a line or a surface contact, instead of a point contact, between the SG pattern and the frame ground is effective for preventing electromagnetic radiation.

However, in this technique, the SG pattern is grounded to the frame ground from one side of the connector via the housing.

Further, Unexamined Patent Publication (Kokai) No. 8-228088 (published on Sep. 3, 1996) discloses a technique for establishing electrical connection between a printed circuit board and a shield case by holding the printed circuit board between Q-shaped protruding guides at three sides of the shield case.

However, this technique necessitates a special process, for the shield case itself, for connection to the printed circuit board, and only three sides of the shield case are shielded.

Still further, examples of prior art include the following.

Unexamined Patent Publication (Kokai) No. 11-220263 discloses a printed circuit board wherein a plurality of ground layers are provided and a power supply layer and a signal layer are sandwiched by the plurality of ground layers.

Unexamined Patent Publication (Kokai) No. 9-64581 discloses a single-layer printed circuit board wherein a grounded circumferencial circuit is provided along the circumference of the board, as well as a multi-layer printed circuit board wherein there is a through-hole that communicates with a grounded circumferencial circuit that is provided at the circumference of the board surface.

Unexamined Patent Publication (Kokai) No. 8-162853 discloses a technique for connecting ground patterns, formed as a plurality of inside layers of a multi-layer printed circuit board, to each other by through-holes and metalized walls.

SUMMARY OF THE INVENTION

In view of the above problem, it is an object of the present invention to provide information processing equipment using a versatile grounding plate that can shield four sides of a printed circuit board securely, and with a simpler configuration, for inhibiting or preventing EMI due to electromagnetic noise in information processing equipment.

In order to achieve the above object, the present invention provides information processing equipment, comprising a printed circuit board mounted in a case, wherein a signal ground pattern is formed at the circumference of the printed circuit board, a connector mounting plate is electrically fixed to one side of the printed circuit board and connected to the signal ground pattern, grounding plates that comprise elastic contacts having a connecting spacing that is smaller than a value determined by a signal wavelength are disposed at the other three sides of the printed circuit board, and the signal ground pattern of the printed circuit board is grounded to a frame pattern of the case.

Further, there is also provided information processing equipment, comprising a printed circuit board mounted in a case, wherein a signal ground pattern is formed at the circumference of the printed circuit board, signal ground vias are provided in the signal ground pattern, a connector mounting plate is fixed to one side of the printed circuit board and electrically connected to the signal ground pattern, and grounding plates that comprise comb-like contacts having a connecting spacing that is smaller than a value determined by a signal wavelength are disposed at the other three side of the printed circuit board so that the signal ground pattern is grounded to a frame pattern of a case by inserting and electrically connecting the comb-like contacts to the signal ground vias.

BRIEF DESCRIPTION OF THE DRAWINGS

The above object and features of the present invention will be more apparent from the following description of the preferred embodiments, and with reference to the accompanying drawings, wherein.

DESCRIPTION OF THE PREFERRED EMBODIMENTS

Before describing the embodiments of the present invention, the related art and the disadvantages therein will be described with reference to the related figures.

Figure 12:
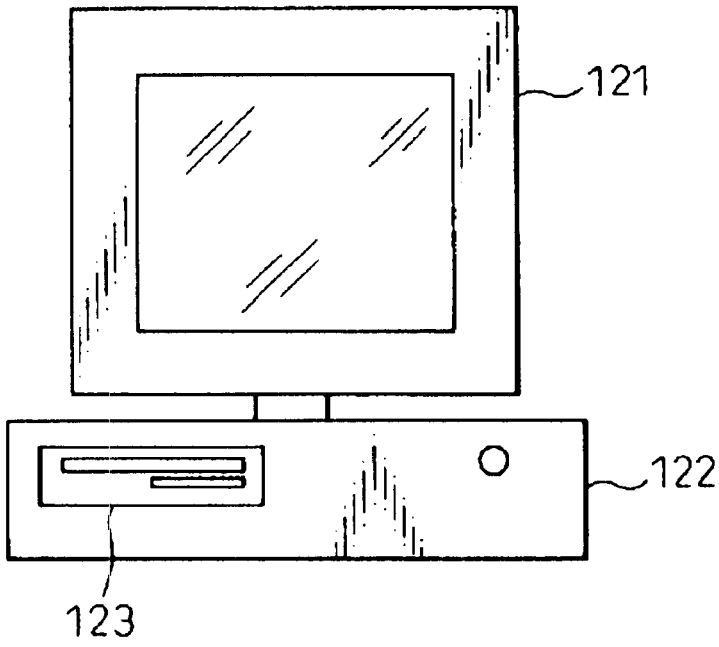
FIG. 12 shows an example of a conventional information processing equipment to which the present invention can be applied.
Figure 13:
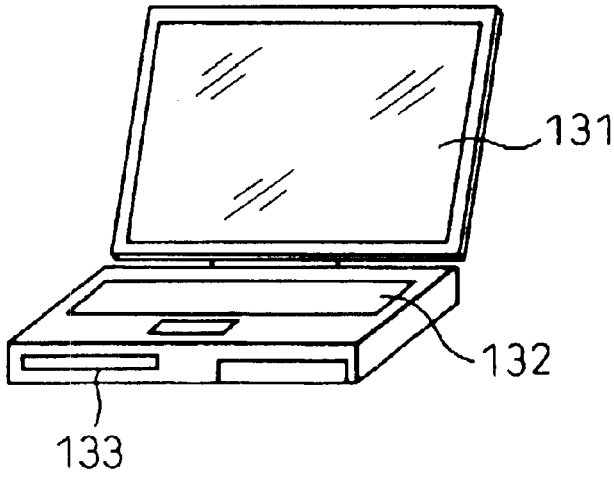
FIG. 13 shows another example of a conventional information processing equipment to which the present invention can be applied.

Conventionally, information processing equipment, such as the examples shown in FIGS. 12 and 13, are well known. FIG. 12 shows a desktop personal computer that comprises a CRT 121 as a display, wherein a removable disk drive 123 such as a FD drive or a CD drive is provided in a main body, and a printed circuit board on which a CPU and other parts are mounted is disposed therein. FIG. 13 shows a notebook personal computer that comprises a liquid crystal display 131, a keyboard 132 and a FD drive 133 and a printed circuit board, on which a CPU and other parts are mounted, is disposed under the keyboard 132.

Figure 14A:
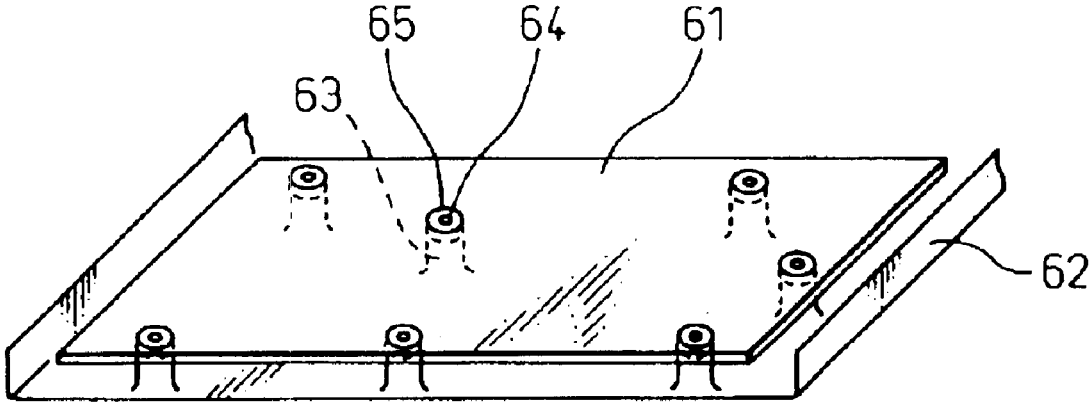
FIG. 14A shows a conventional printed circuit board disposed in a case.
Figure 14B:
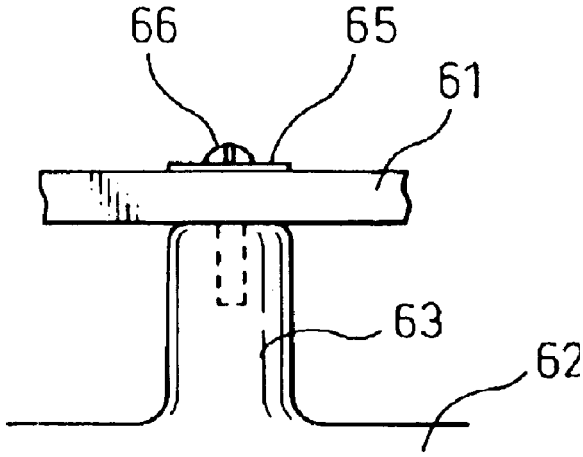
FIG. 14B shows an electrical connection between the conventional printed circuit board and the case.

FIGS. 14A and 14B are schematic views showing the relationship between the printed circuit board and the case for preventing EMI in the conventional information processing equipment.

As shown in FIG. 14A, the printed circuit board 61 such as a main board of a personal computer is mounted on a plurality of bosses 63 provided on the bottom surface of the case 62. The printed circuit board 61 is composed of laminated sheets wherein printed wiring is applied to each of the laminated sheets and various electronic parts (not shown) are mounted on the printed circuit board. Further, the printed circuit board 61 is provided with a plurality of through holes 64 that correspond to screw holes on the plurality of bosses 63 and ground pads 65 are provided around the through holes 64. The inside surfaces of the through holes 64 and the ground pads 65 are treated to be conductive and a signal ground pattern (hereinafter referred to as the "SG pattern") which is not shown is connected to them. At least the bottom surface of the case 62 is electrically conductive and constitutes a frame ground.

Then, as shown in FIG. 14B, the printed circuit board 61 is secured to the case 62 and the SG pattern of the printed circuit board 61 is connected to the frame ground by screws 66 fastening the printed circuit board 61 to the case 62 so that the impedance can be decreased and EMI can be prevented.

As described above, in the information processing equipment, as the operating frequency increases as CPUs become faster, for the prevention of EMI, it is necessary to connect the SG pattern of the printed circuit board to the frame ground of the case at multiple points and at minimum spacing (1/10 or less of a clock frequency wavelength $\lambda$). In the conventional information processing equipment, when the spacing is reduced by increasing the number of bosses for mounting the printed circuit board, there is a problem in that productivity is reduced because area cost is increased and the mounting efficiency is also reduced because more screws must be used.

Next, embodiments that implement the present invention will be described. The present invention is intended to solve the above problems.

Figure 1:
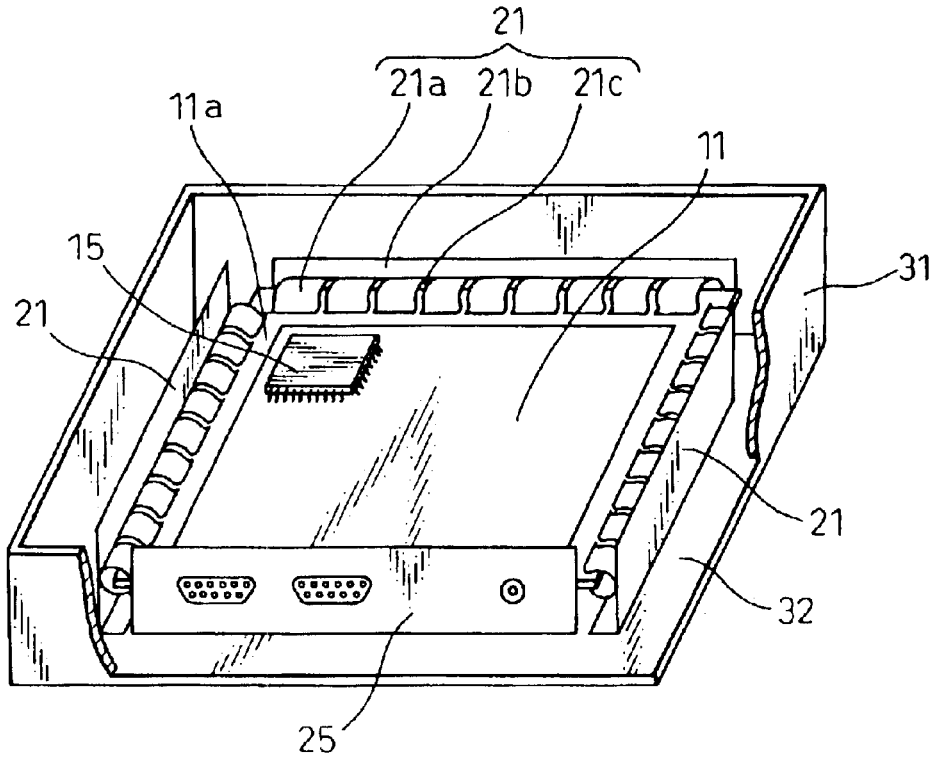
FIG. 1 is a partially cutaway perspective view of a case of an information processing equipment according to a first embodiment of the present invention.

FIG. 1 is a partially cutaway schematic perspective view of a case for information processing equipment according to a first embodiment of the present invention.

A printed circuit board 11 is enclosed in a case 31 and a conductive mounting plate 25 to which connectors and the like are attached is provided at one side of the printed circuit board.

At the circumference of the top surface of the outermost layer of the printed circuit board 11, an SG pattern 11*a* is provided. The SG pattern 11*a* is configured to be wider than signal wiring patterns. Besides the SG pattern 11*a* of the printed circuit board 11, electronic parts 15 such as integrated circuits are mounted and the signal wiring patterns are provided as usual (though not shown).

At the circumference of the printed circuit board 11, three ground plates 21 are disposed at each side of the printed circuit board 11 other than the side at which the mounting plate 25 is disposed.

The three grounding plates 21 are mounted and secured by screws and the like on a frame ground 32 that is provided on the bottom surface of the case 31. This allows the SG pattern 11*a* to be connected to the frame ground 32 via the grounding plates 21.

Figure 2:
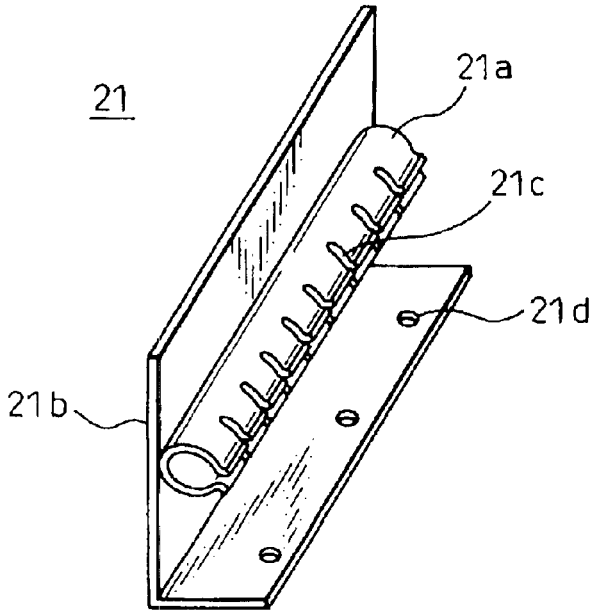
FIG. 2 shows a grounding plate according to the first embodiment of the present invention.

As shown in FIG. 2, the grounding plate 21 is comprised of a spring-like contact 21*a* that is an elastic contact and a L-type support 21*b*. The grounding plate 21 is formed of metal in this example, but it may alternatively be formed of a conductive plastic, or a plastic having a surface that is treated to be conductive.

The spring-like contact 21*a* is comprised of a metal pipe a side of which is cut longitudinally so that the printed circuit board 11 is inserted therebetween. Both sides of the cut portion are rounded to facilitate insertion of the printed circuit board. Further, a plurality of slits 21*c* are provided appropriately in the longitudinal direction to facilitate handling and prevent uneven contact. Though the spacing between the slits 21*c* can be selected as appropriate within a range not more than 1/10 of a signal wavelength, it is preferable to reduce the spacing as much as possible to implement multiple-point contact or line contact, if possible.

The support 21*b* is formed by bending a metal plate in the L-shape. The support 21*b* is provided with screw holes 21*d* and secured to the frame ground of the case by screws. It may alternatively be secured by adhesive means such as a conductive adhesive. The spring-like contact 21*a* is joined to the L-type support 21*b* by soldering and the like.

Figure 3:
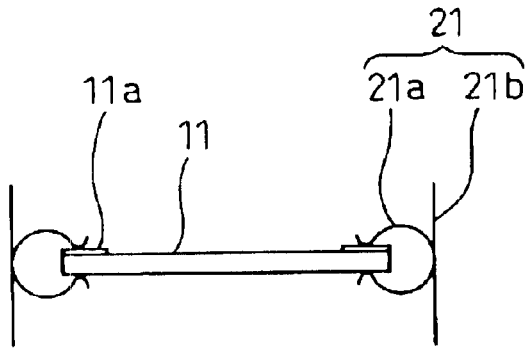
FIG. 3 is a schematic view showing electrical connection between the grounding plates and a printed circuit board according to the first embodiment of the present invention.

FIG. 3 shows the electrical connection between the grounding plates 21 and the printed circuit board 11. The printed circuit board 11 is inserted into the grounding plates 21 so that the spring-like contacts come into contact with the SG pattern to provide electrical continuity. In this example, the SG pattern is not provided on the underside of the outermost layer of the printed circuit board 11. When there is signal wiring at the circumference of the underside of the printed circuit board 11, an insulating layer consisting of an insulating film and the like is provided over the signal wiring where the underside of the spring-like contacts 21*a* is contacted so that there is no electrical continuity therebetween. However, if it is necessary to further prevent EMI, the SG pattern may also be provided at the circumference of the underside of the printed circuit board 11 so that an electrical connection is provided also at the underside of the spring-like contact 21*a*.

Figure 4:
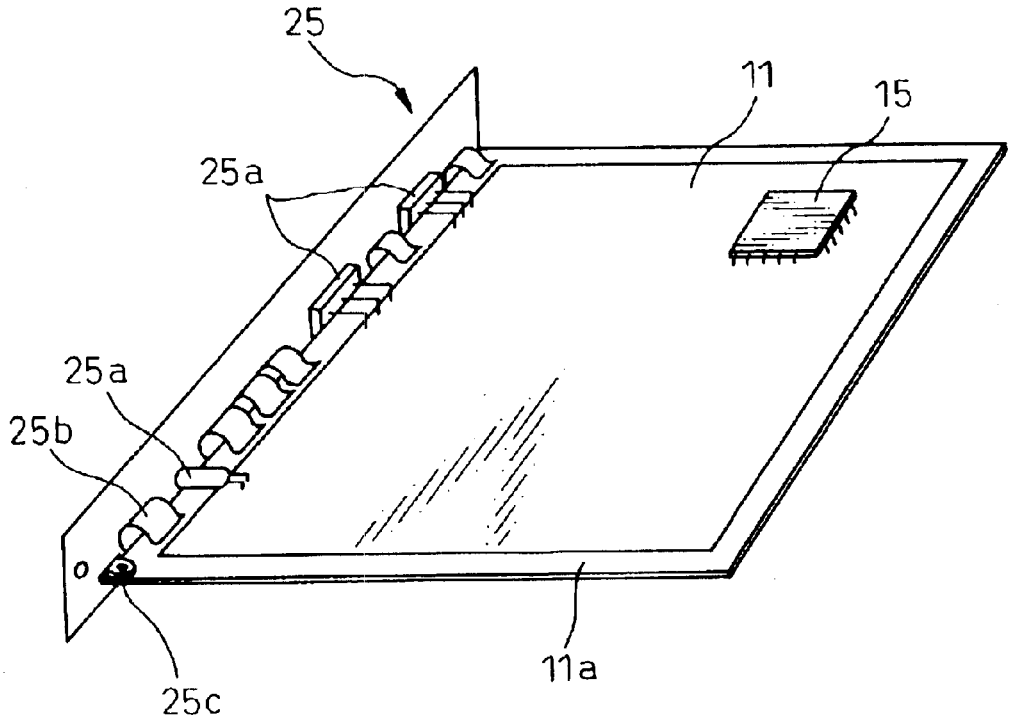
FIG. 4 is a diagram showing the printed circuit board comprising a mounting plate according to the first embodiment of the present invention.

FIG. 4 shows connecting relationship between the printed circuit board and the mounting plate 25. The mounting plate 25 is formed of a conductive member such as a metal plate, holds various connectors 25*a*, and comprises spring-like contacts 25*b* similar to those of the grounding plate.

Figure 5:
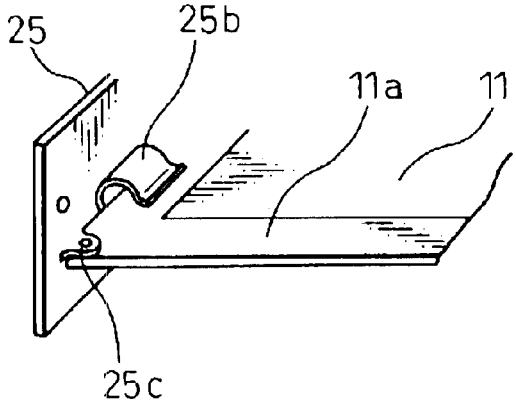
FIG. 5 shows a part where the mounting plate and the printed circuit board are fixed to each other.

As shown in FIG. 5, the mounting plate 25 is secured to the printed circuit board 11 by fixing parts 25*c*. The fixing parts 25*c* are intended for fastening the mounting plate 25 to the printed circuit board by screws and are provided at least at both ends of the printed circuit board. The fixing parts 25*c* may be provided by cutting and bending portions of the mounting plate itself or may be formed as members independent of the mounting plate 25. On the other hand, the fixing parts 25*c* are secured to the SG pattern 11*a* of the printed circuit board 11 to provide electrical continuity to the SG pattern 11*a*. Thus, by means of the spring-like contacts 25*b* and the fixing parts 25*c*, the mounting plate 25 establishes electrical continuity with the grounding plate 21 via the SG pattern and it is grounded to the frame ground.

Figure 6:
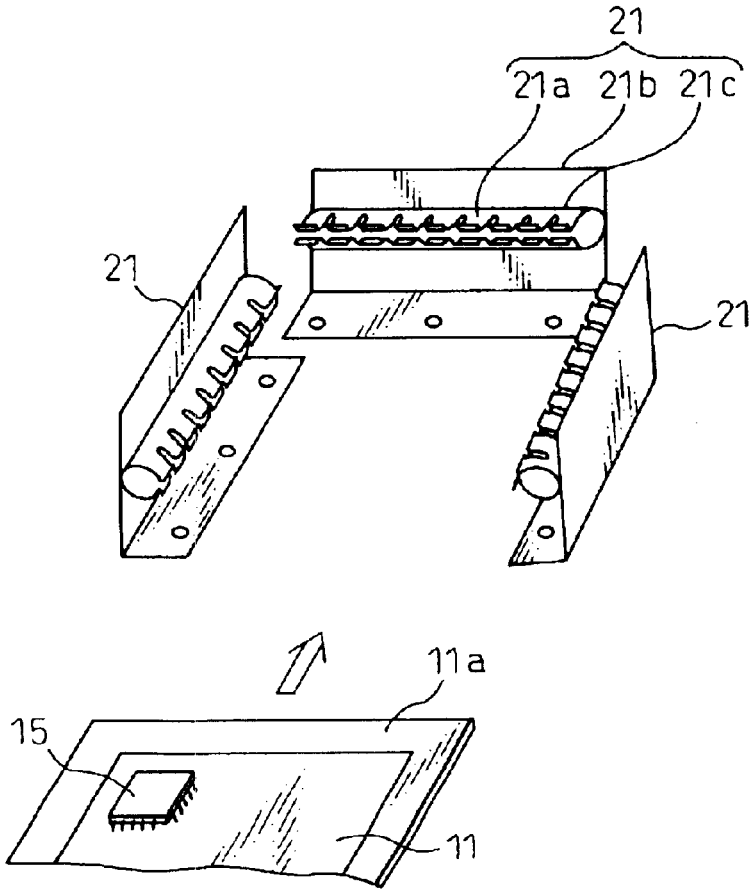
FIG. 6 shows how the printed circuit board that is provided with the mounting plate is inserted and fixed to the grounding plates according to the first embodiment of the present invention.

FIG. 6 shows a process for disposing the printed circuit board 11 in the case 31. The three grounding plates are secured to a metal plate that represents the frame ground so that the grounding plates can hold the printed circuit board. Then, the assembly is completed by inserting the printed circuit board to the spring-like supports of the grounding plates wherein the mounting plate is secured to one side of the printed circuit board.

Here, though not shown, for mechanically supporting the printed circuit board with reference to the case, the printed circuit board may be fastened to a small number of the bosses provided on the bottom surface of the case using screws. At this time, the electrical connection between the SG pattern and the case ground through the bosses may be used in combination in a conventional manner.

Figure 7:
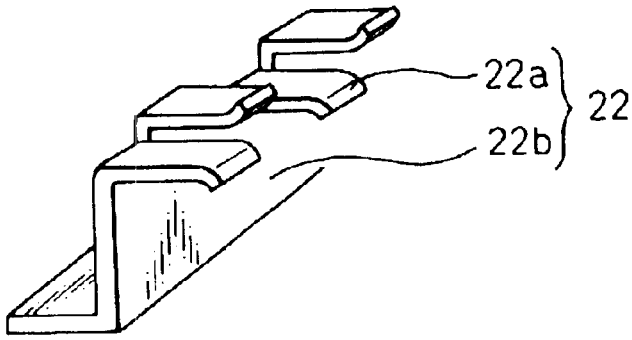
FIG. 7 shows another example of the grounding plate according to the first invention of the present invention.

FIG. 7 shows another example of the grounding plate according to the first embodiment of the present invention. The grounding plate 22 is comprised of one rectangular metal plate that has tongues 22*a* that represent elastic contacts and a support 22*b*. The tongues 22*a* are formed by making a plurality of slits at one side of the metal plate in the longitudinal direction and bending the portions between the slits by bending depths which are different alternately. The support is formed by bending the other side of the metal plate in the longitudinal direction.

The tongues 22*a* of the grounding plate 22 hold the printed circuit board 11 therebetween while the support 22*b* of the grounding plate 22 is secured to the frame ground. The tongues 22*a* make contact with the topside and the underside of the printed circuit board alternately and the distance between two adjacent tongues 22*a* on one side is substantially equal to the width of the tongue 22*a*. The distance between the tongues 22*a* on one side or the width of the tongue 22*a* must be 1/10 or less of the signal wavelength. In order to facilitate insertion of the printed circuit board, the tips of the tongues 22*a* are smoothly bent outward from each other.

Figure 8A:
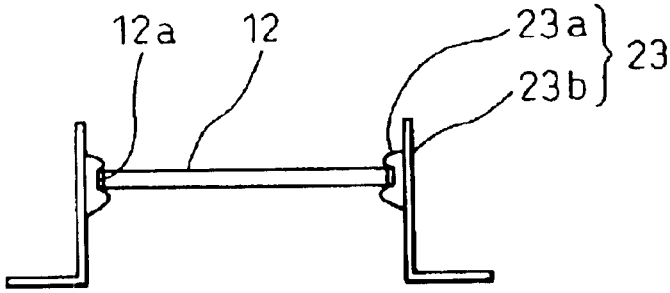
FIG. 8A is a schematic view showing electrical connection between grounding plates and a printed circuit board according to a second embodiment of the present invention.
Figure 8B:
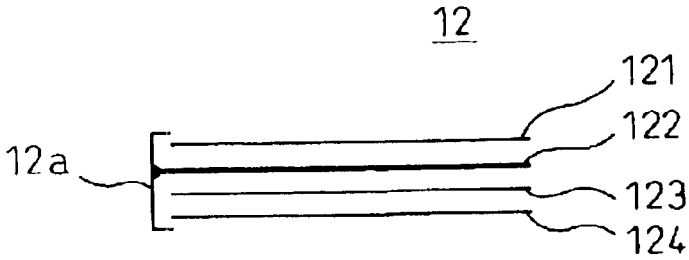
FIG. 8B is a schematic view showing a cross section of the printed circuit board used in the second embodiment of the present invention.

FIGS. 8A and 8B show a second embodiment of the present invention. This embodiment is preferable when it is difficult to form the SG pattern on the surface of the outermost layer of the printed circuit board. The printed circuit boards typically have laminated constructions in which a plurality of layers are laminated wherein the SG pattern is often formed inside the laminated construction.

As an example of the printed circuit board used in this embodiment, FIG. 8B shows a cross section of a printed circuit board 12 that comprises four wiring layers. There are shown a signal layer 121, a SG layer 122 having a SG pattern, a power supply layer 123 and another signal layer 124. Further, a conductive layer 12*a*, that is comprised of a conductive film and the like, is placed on an end surface of the printed circuit board. The conductive layer 12*a* is electrically connected to the SG pattern of the SG layer 122 inside the printed circuit board.

As shown in FIG. 8A, one of grounding plates 23 consists of a gasket 23*a* that represents an elastic contact and a support 23*b*. The gasket 23*a* that represents the elastic contact consists of a flexible member wherein a polyurethane or other resin is covered with conductive cloth. The grounding plates 23 are disposed correspondingly to three conductive end faces 12*a* of the printed circuit board 12 in a manner similar to the example described above. Then, the gaskets 23*a* of the ground plates 23 come into contact with the conductive surfaces 12*a* of the printed circuit board 12 so that the electrical continuity between the SG pattern of the printed circuit board 12 and the frame ground of the case is established.

Just as in the embodiment described above, the three grounding plates are disposed and a mounting plate to which connectors and the like are attached is secured to the remaining one side of the printed circuit board. Along with the connectors and the like, the mounting plate is provided with conductive gaskets in place of the spring-like terminals described above so that the electrical continuity to the SG pattern 12*a* of the printed circuit board 12 is established. In this example, the fixing parts of the mounting plate contribute only to mechanical fixation of the printed circuit board.

Though D-type gaskets are shown in the figure, the shape of the gaskets, such as U-type, L-type and so on, may be selected as appropriate. As shown, it is preferable that the gaskets 23*a* are deformed to cover the conductive surfaces 12*a* of the end faces of the printed circuit board. In this example, it is also preferable to support the printed circuit board 12 with regard to the case by suitable means to mechanically support the printed circuit board 12, such as by conventional screws to fasten the printed circuit board to the bosses on the bottom surface of the case. Further, the electrical connection between the SG pattern and the frame ground by means of conventional bosses may be used in combination.

According to this embodiment, even when the SG pattern cannot be formed on the surface of the outermost layer of the printed circuit board, undesired electromagnetic radiation can be prevented effectively.

Figure 9:
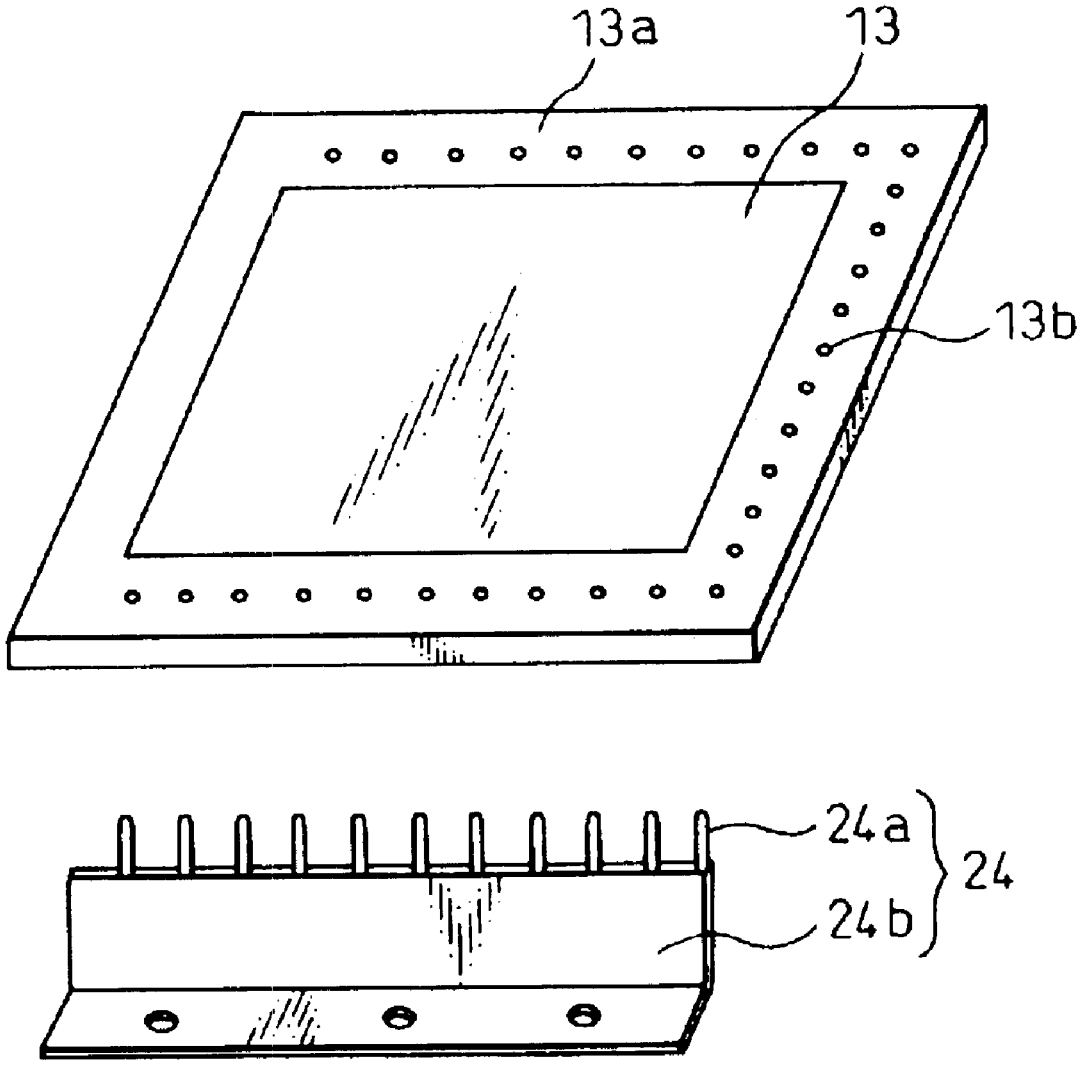
FIG. 9 shows a ground plate and a printed circuit board according to a third embodiment of the present invention.

FIG. 9 shows a third embodiment of the present invention.

In the third embodiment shown in FIG. 9, an SG pattern is provided at the circumference of four sides of a multi-layer printed circuit board 13 and a large number of SG vias 13*b* are provided on three sides of the four sides of the printed circuit board. The SG vias 13*b* are through holes that penetrate the printed circuit board and the inner surfaces are formed of a conductor to establish electrical continuity to the SG pattern. The SG vias 13*b* differ from the through holes for screws that correspond to the bosses in that the SG vias have a smaller diameter to the extent that lead pins of the connectors can pass through. In order to inhibit EMI, the distance between the adjacent SG vias 13*b* must be smaller than 1/10 of the signal wavelength.

In contrast to this, a grounding plate 24 comprises a comb-like contact 24*a* that corresponds to the SG vias 13*b* and a support 24*b*. Three grounding plates 24 are prepared for the printed circuit board that is provided with the SG vias 13*b* so that the comb-like contact 24*a* is inserted and soldered to the SG vias 13*b*. The support 24*b* of the ground plates is formed in an L-type configuration and is mounted and secured on the frame ground. It establishes the electrical continuity between the SG pattern and the case ground.

Figure 10:
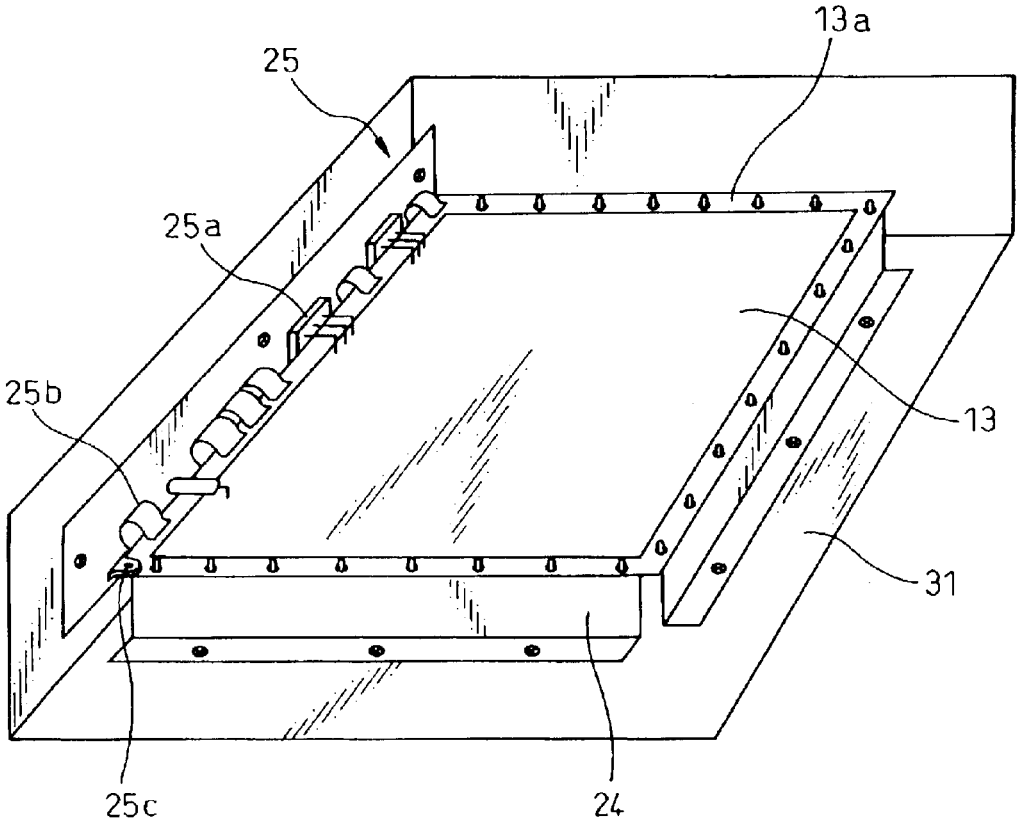
FIG. 10 shows how the printed circuit board 13 to which the mounting plate is fixed is inserted and fixed to the grounding plates 13 according to the third embodiment of the present invention.

FIG. 10 shows a combination of the printed circuit board 13 to which the mounting plate 25 is attached and the grounding plates 24. Just as in the first embodiment, the mounting plate 25 comprises the connectors 25*a*, is secured to the printed circuit board by means of the fixing parts 25*c* and is in electrical continuity with the SG pattern 13 through the spring-like contacts 25*b*. Thus, the printed circuit board is combined with the grounding plates by inserting the printed circuit board to which the mounting plate is attached between the grounding plates secured on the bottom surface of the case 31 from above the grounding plates 24 so that the comb-like contact 24*a* of the grounding plate 24 is inserted to the SG vias 13*b*.

Through such a process, the SG ground of the printed circuit board can be connected to the frame ground of the case at multiple points that are spaced away each other by a distance smaller than 1/10 of the signal wavelength, and at the same time, the mechanical support for the printed circuit board can be completed. Here, it is to be noted that the electrical contact between the comb-like contacts 24*a* and the SG vias 13*b* of the printed circuit board can alternatively be implemented by only mechanical contact and without soldering.

Further, this embodiment can also be applied to the case when the SG pattern is formed on an inside layer of a multi-layer printed circuit board.

Figure 11A:
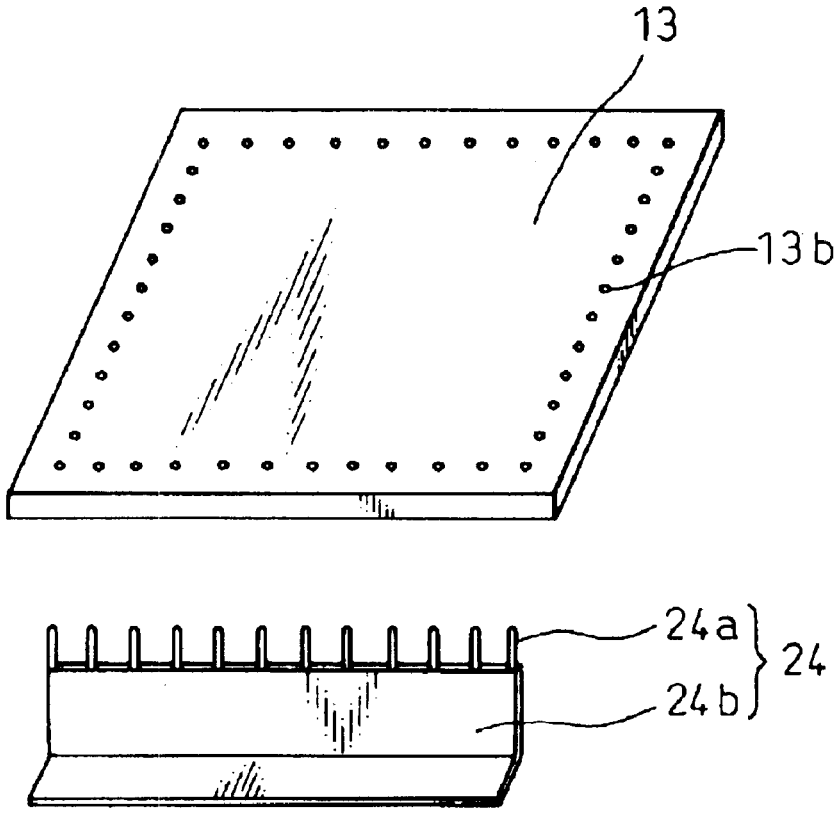
FIG. 11A shows an example wherein a SG pattern is formed on an inside layer of the printed circuit board according to the third embodiment of the present invention.
Figure 11B:
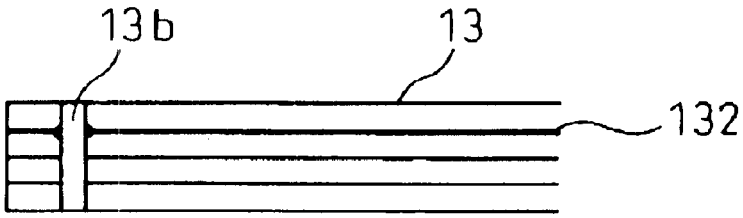
FIG. 11B is a schematic view showing a cross section of the printed circuit board.

FIGS. 11A and 11B show the relationship between the printed circuit board 13 and the grounding plate 24 when the SG pattern is formed on an inside layer of the multi-layer printed circuit board.

The SG pattern is not formed on the outermost layer of the four-layer printed circuit board 13, but an SG layer is formed inside the four-layer printed circuit board. FIG. 11B schematically shows how the electrical connection between the SG vias 13*b* and the SG layer 132 is established. A large number of such SG vias 13*b* are provided at the circumference of four sides of the printed circuit board and four grounding plates each of which has a comb-like contact 24*a* are used correspondingly.

By inserting the comb-like contacts 24*a* of the four grounding plates 24 into the large number of SG vias 13*b* of the printed circuit board 13, the electrical continuity between the grounding plates 24 and the SG pattern provided at the circumference of the printed circuit board can be established and measures against the EMI can be taken at the four sides of the printed circuit board.

Here, as the mounting plate to which the connectors and the like are attached does not interfere with the grounding plates in this case, the mounting plate may be attached to any of the four sides of the printed circuit board wherein the electrical continuity between the mounting plate and the printed circuit board is not especially needed, but the mounting plate may be in electrical contact with one of the grounding plates at the same side at which the mounting plate is disposed.

Further, also in the case shown in FIG. 9, the SG vias may be provided at four sides of the printed circuit board and the corresponding four grounding plates 24 may be used.

In this example, as the grounding plates 24 also mechanically support the printed circuit board 13, other members for mechanical support may not be needed.

Still further, in each example of the embodiments of the present invention, though three grounding plates are provided and disposed to be attached to each corresponding side of the printed circuit board, one U-shaped grounding plate into which the three grounding plates are integrated may alternatively provided to be connected with the printed circuit board. Further, when the grounding plates 24 are used, four of the grounding plates may be integrated.

Thus, according to the present invention, there is provided an information processing equipment that takes effective measures against the EMI at the four sides of the printed circuit board by disposing grounding plates to electrically connect the SG pattern to the frame ground at three sides of the printed circuit board other than the side at which the connector mounting plate is disposed wherein the connector mounting plate is also connected to the frame ground via the grounding plates.

Further, in the embodiment wherein the electrical continuity is established by the elastic contacts of the grounding plates that make contact with the conductive portions that are electrically connected to the SG pattern provided on the inside layer of the printed circuit board, even though the SG pattern is located on the inside layer of the printed circuit board, EMI can be prevented effectively.

Still further, in the embodiment wherein the electrical continuity between the SG pattern and the frame ground is established by providing the SG vias that protrude the printed circuit board and inserting comb-like contacts of the grounding plates into the SG vias, the EMI can be prevented effectively and the mechanical support for the printed circuit board can be provided by only the grounding plates.

What is claimed is:

1. Information processing equipment comprising:

a case on the bottom surface of which a frame ground is formed;

a printed circuit board mounted in said case, wherein a signal ground pattern is formed at the circumference of said printed circuit board and a connector mounting plate is secured to one side of said printed circuit board and electrically connected to said signal ground pattern; and grounding plates secured to said frame ground on the bottom surface of said case, wherein said grounding plates have elastic contacts that are electrically connected to said signal ground pattern at the other three sides of said printed circuit board and spaced away from each other by a distance smaller than a value determined by a signal wavelength.

2. Information processing equipment according to claim 1, wherein said elastic contacts of said grounding plates are spring-like contacts that are configured by longitudinally forming a cut portion on a side of pipes and said cut portion holds said signal ground pattern formed on the surface of said printed circuit board therebetween.

3. Information processing equipment according to claim 1, wherein said elastic contacts of said grounding plates are spring-like contacts that consist of a plurality of tongues that are bent at one side of a metal plate and said tongues hold said signal ground pattern formed on the surface of said printed circuit board therebetween.

4. Information processing equipment according to claim 1, wherein said signal ground pattern is formed at the circumference of the top and bottom surfaces of said printed circuit board.

5. Information processing equipment according to claim 1, wherein said elastic contacts of said grounding plates consist of conductive gaskets and are elastically pressed against said signal ground pattern formed at the side of said printed circuit board.

6. Information processing equipment according to claim 1, wherein said grounding plates are formed of a conductive plastic, or a plastic having a surface that is treated to be conductive.

7. Information processing equipment according to claim 1, wherein three members that correspond to each side of said printed circuit board are integrated into said grounding plate.

8. Information processing equipment comprising:

a case on the bottom surface of which a frame ground is formed;

a printed circuit board mounted in said case, wherein a signal ground pattern is formed at the circumference of said printed circuit board, signal ground vias are provided in said signal ground pattern in at least three sides of said printed circuit board, and a connector mounting plate is secured to one side of said printed circuit board and electrically connected to said signal ground pattern; and grounding plates secured to said frame ground on the bottom surface of said case, wherein said grounding plates have comb-like contacts that are inserted and electrically connected to said signal ground vias of said printed circuit board and spaced away from each other by a distance smaller than a value determined by a signal wavelength.

9. Information processing equipment according to claim 8, wherein said grounding plates are formed of a conductive plastic, or a plastic having a surface that is treated to be conductive.

10. Information processing equipment according to claim 8, wherein the three members that correspond to each side of said printed circuit board are integrated into said grounding plate.

11. Information processing equipment comprising:

a case on the bottom surface of which a frame ground is formed;

a printed circuit board mounted in said case, wherein signal ground pattern is formed at the circumference of an internal laminated sheet of said printed circuit board, signal ground vias are provided at four sides of said signal ground pattern of said printed circuit board, and a connector mounting plate is secured to one side of said printed circuit board; and grounding plates secured to said frame ground on the bottom surface of said case, wherein said grounding plates have comb-like contacts that are inserted and electrically connected to said signal ground vias of said printed circuit board and spaced away from each other by a distance smaller than a value determined by a signal wavelength.

12. Information processing equipment according to claim 11, said grounding plates are formed of a conductive plastic, or a plastic having a surface that is treated to be conductive.

13. Information processing equipment according to claim 11, wherein four members that correspond to each side of said printed circuit board are integrated into said grounding plate.

* * * * *